US010360847B2

(12) United States Patent
Lee et al.

(10) Patent No.: US 10,360,847 B2
(45) Date of Patent: Jul. 23, 2019

(54) DISPLAY APPARATUS AND CONTROL METHOD THEREOF

(71) Applicant: SAMSUNG ELECTRONICS CO., LTD., Suwon-si (KR)

(72) Inventors: Min-woo Lee, Hwaseong-si (KR); Han-tak Kwak, Seongnam-si (KR); Won-hee Choe, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 235 days.

(21) Appl. No.: 15/007,741

(22) Filed: Jan. 27, 2016

(65) Prior Publication Data

US 2017/0011692 A1 Jan. 12, 2017

(30) Foreign Application Priority Data

Jul. 10, 2015 (KR) ..... 10-2015-0098469

(51) Int. Cl.
*G09G 3/3233* (2016.01)

(52) U.S. Cl.
CPC ... *G09G 3/3233* (2013.01); *G09G 2300/0842* (2013.01); *G09G 2320/0673* (2013.01); *G09G 2320/0686* (2013.01); *G09G 2360/16* (2013.01)

(58) Field of Classification Search
CPC ..... G09G 5/02; G09G 2360/16; G09G 2320/0233; G09G 2320/0276; G09G 2320/0626; G09G 2320/0271; H04N 13/128; H04N 1/60; H04N 2101/00; H04N 5/23245; H04N 9/69; G06T 7/194; G06T 7/11; G06T 2207/20021
See application file for complete search history.

(56) References Cited

U.S. PATENT DOCUMENTS

| | | | |
|---|---|---|---|
| 5,633,511 | A | 5/1997 | Lee et al. |
| 6,735,330 | B1 | 5/2004 | Van Metter et al. |
| 8,059,110 | B2 | 11/2011 | Whitehead et al. |
| 8,606,009 | B2 | 12/2013 | Sun |
| 8,994,762 | B2 | 3/2015 | Kim et al. |

(Continued)

FOREIGN PATENT DOCUMENTS

| | | | |
|---|---|---|---|
| JP | 9-191408 | A | 7/1997 |
| JP | 2002-207474 | A | 7/2002 |

(Continued)

OTHER PUBLICATIONS

Written Opinion dated Oct. 13, 2016 issued by International Searching Authority in counterpart International Application No. PCT/KR2016/006992 (PCT/ISA/237).

(Continued)

*Primary Examiner* — Gerald Johnson
(74) *Attorney, Agent, or Firm* — Sughrue Mion, PLLC

(57) ABSTRACT

A display apparatus is provided. The display apparatus includes: an image inputter configured to receive an image; a display panel comprising a plurality of pixels; a panel driver configured to drive the plurality of pixels of the display panel on a pixel basis to display the image; and a processor configured to divide the image into a plurality of areas based on a grayscale characteristic of the image, and control the panel driver to individually adjust brightness of at least one of the plurality of areas.

15 Claims, 27 Drawing Sheets

(56) References Cited

U.S. PATENT DOCUMENTS

| | | | | |
|---|---|---|---|---|
| 2004/0196303 | A1* | 10/2004 | Matsuda | H04N 9/3182 345/690 |
| 2005/0253835 | A1 | 11/2005 | Kawase | |
| 2007/0002003 | A1 | 1/2007 | Kim | |
| 2008/0150853 | A1 | 6/2008 | Peng et al. | |
| 2009/0066819 | A1* | 3/2009 | Ando | G06T 5/009 348/254 |
| 2011/0026051 | A1 | 2/2011 | Wang | |
| 2012/0069061 | A1 | 3/2012 | Kim | |
| 2013/0249955 | A1 | 9/2013 | Kim et al. | |
| 2014/0037190 | A1* | 2/2014 | Wang | G06T 5/006 382/154 |
| 2014/0092117 | A1* | 4/2014 | Yoshimura | G09G 5/02 345/589 |
| 2016/0350940 | A1* | 12/2016 | Wang | G06T 7/0012 |

FOREIGN PATENT DOCUMENTS

| | | | |
|---|---|---|---|
| KR | 10-2006-0046635 | A | 5/2006 |
| KR | 10-2012-0112709 | A | 10/2012 |
| KR | 10-2013-0108822 | A | 10/2013 |

OTHER PUBLICATIONS

International Search Report dated Oct. 13, 2016 issued by International Searching Authority in counterpart International Application No. PCT/KR2016/006992 (PCT/ISA/210).

* cited by examiner

DISPLAY APPARATUS AND CONTROL METHOD THEREOF

CROSS-REFERENCE TO RELATED APPLICATIONS

This application claims priority from Korean Patent Application No. 10-2015-0098469, filed on Jul. 10, 2015, in the Korean Intellectual Property Office, the disclosure of which is incorporated herein by reference in its entirety.

BACKGROUND

1. Field

Apparatuses and methods consistent with exemplary embodiments relate to directly controlling brightness of respective pixels of a display panel.

2. Description of the Related Art

Due to the development of electronic technology, various kinds of display apparatuses are currently used. For example, the display apparatus may include a television (TV), a monitor, an electronic display board, an electronic album, a kiosk, a mobile phone, a beam projector, etc.

The liquid crystal display (LCD) widely used in the display apparatuses adopts a method which uses a backlight unit as a light source, and expresses a specific image by outputting only desired colors through the light source. The backlight unit of the LCD is a single surface light source and illuminates the entire display. The pixels of the LCD are configured to divide light into 256 levels in total, that is, 0 to 255 levels, through liquid crystals.

FIG. 18 is a view to illustrate a brightness control method in a related-art LCD.

As described above, the LCD uses a single light source and thus all of the pixels have the same maximum brightness of light, and uniformly divide the light into 256 levels, that is, 0 to 255 levels, to generate an image from the light.

Therefore, there is a problem that the amount of dynamic range per pixel in an image is determined based on 256 levels.

SUMMARY

Exemplary embodiments address at least the above problems and/or disadvantages and other disadvantages not described above. Also, the exemplary embodiments are not required to overcome the disadvantages described above, and may not overcome any of the problems described above.

One or more exemplary embodiments provide a display apparatus which enhances image quality by individually controlling brightness of respective pixels based on characteristics of an inputted image, and an image display method thereof.

According to an aspect of an exemplary embodiment, there is provided a display apparatus including: an image inputter configured to receive an image; a display panel including a plurality of pixels; a panel driver configured to drive the plurality of pixels of the display panel on a pixel basis to display the image; and a processor configured to divide the image into a plurality of areas based on a grayscale characteristic of the image, and control the panel driver to individually adjust brightness of at least one of the plurality of areas.

The processor may be further configured to apply different gamma tables to each of the plurality of areas, and control to individually adjust brightness of each of the plurality of areas based on the applied gamma tables. The gamma tables may indicate a relationship between a grayscale and brightness of the image, and comprise at least one of a minimum brightness level and a maximum bright level different from each other.

The different gamma tables may comprise a first gamma table and a second gamma table that has a higher minimum brightness level and a higher minimum level than the first gamma table, and the plurality of areas may comprise a first area and a second area that has a higher greyscale than the first area. The processor may be further configured to apply the first gamma table to the first area and apply the second gamma table to the second area.

The processor may be configured to divide at least one area from among the plurality of areas into a plurality of subareas based on a grayscale distribution of pixels in the at least one of the plurality of areas, and control to individually adjust brightness of at least one of the plurality of subareas.

The processor may be further configured to analyze a grayscale distribution of the plurality of pixels of the image, divide an entire grayscale section of the image into a plurality of grayscale sections based on the analyzed grayscale distribution, and control to individually adjust brightness of the plurality of areas of the image by applying to at least one of the plurality of areas a gamma table corresponding to at least one of the plurality of grayscale sections.

The processor may be further configured to divide the image into a plurality of areas according to a predetermined criterion, and control to individually adjust brightness of at least one of the plurality of areas based on a grayscale distribution of pixels in the plurality of divided areas.

The processor may be configured to control to individually adjust brightness of an object area based on a grayscale characteristic of the object area satisfying a predetermined condition from among a plurality of object areas of the image.

The object area satisfying the predetermined condition may be an interest object area.

When the display apparatus is operated in a low power mode, the processor may be configured to adjust an inter-grayscale brightness mapping gap by rescaling at least one grayscale section of the image based on a maximum brightness level pre-set in the low power mode.

The plurality of pixels may be implemented by using self-emitting elements.

According to an aspect of another exemplary embodiment, there is provided a driving method of a display apparatus, which includes a display panel including a plurality of pixels which are controlled on a pixel basis to display an image, including: dividing the image into a plurality of areas based on a grayscale characteristic of the image; and driving the display panel to individually adjust brightness of at least one of the plurality of areas.

The driving the display panel may include: applying different gamma tables to each of the plurality of areas, and driving the display panel to individually adjust brightness of each of the plurality of area based on the applied gamma table. The gamma tables may indicate a relationship between a grayscale and brightness of the image, and include at least one of a minimum brightness level and a maximum bright level different from each other.

The different gamma tables may include a first gamma table and a second gamma table that has a higher minimum brightness level and a higher minimum level than the first gamma table, and the plurality of areas may include a first area and a second area that has a higher greyscale than the first area. The driving the display panel may include driving the display panel by applying the first gamma table to the first area applying the second gamma table to the second area.

The driving method may further include dividing at least one area from among the plurality of areas into a plurality of subareas based on a grayscale distribution of pixels in the at least one of the plurality of areas, and the driving the display panel may include driving the display panel to individually adjust brightness of at least one of the plurality of subareas.

The dividing the image into the plurality of areas may include analyzing a grayscale distribution of pixels of the image, and dividing an entire grayscale section of the image into a plurality of grayscale sections based on the analyzed grayscale distribution. The driving the display panel may include driving the display panel to individually adjust brightness of the plurality of areas of the image by applying to at least one of the plurality of areas a gamma table corresponding to at least one of the plurality of grayscale sections.

The dividing the image into the plurality of areas may include dividing the image into a plurality of areas according to a predetermined criterion, and the driving the display panel may include driving the display panel to individually adjust brightness of at least one of the plurality of areas based on a grayscale distribution of pixels in the plurality of divided areas.

The driving the display panel may include driving the display panel to individually adjust brightness of an object area of the image based on a grayscale characteristic of the object area satisfying a predetermined condition from among a plurality of object areas of the image.

The driving the display panel may include, when the display apparatus is operated in a low power mode, adjusting an inter-grayscale brightness mapping gap by rescaling at least one grayscale section of the image based on a maximum brightness level pre-set in the low power mode.

The plurality of pixels may be implemented by using self-emitting elements.

The grayscale section of the image may include 256 stages.

According to an aspect of another exemplary embodiment, there is provided a display apparatus including: a display panel comprising a plurality of pixels; a panel driver configured to drive the plurality of pixels on a pixel basis to display an image; and a processor configured to identify a grayscale characteristic of each of the plurality of pixels, recognize the plurality of pixels as at least two groups based on the grayscale characteristic, and apply different gamma tables to the at least two groups of the plurality of pixels to adjust brightness of the image.

According to the various exemplary embodiments described above, power consumption of a self-emission display may be reduced and image quality may be enhanced.

BRIEF DESCRIPTION OF THE DRAWING

The above and/or other aspects will be more apparent by describing certain exemplary embodiments, with reference to the accompanying drawings, in which.

DETAILED DESCRIPTION

Figure 1:
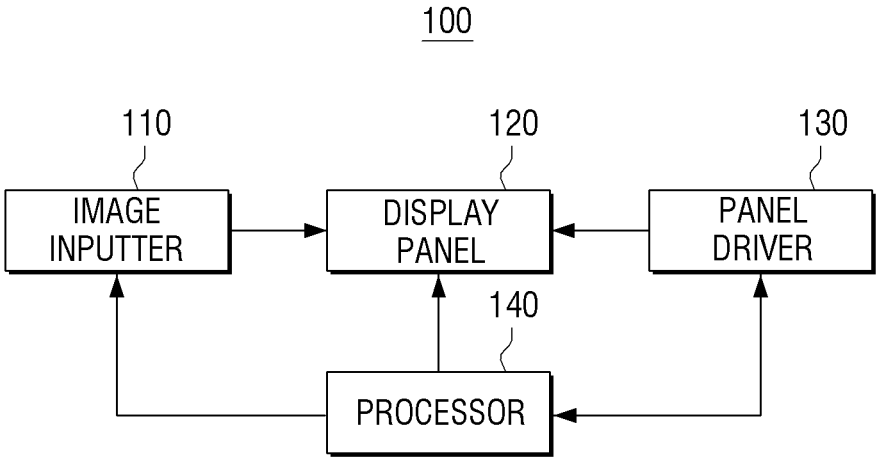
FIG. 1 is a block diagram to illustrate a configuration of a display apparatus according to an exemplary embodiment.

Exemplary embodiments are described in greater detail below with reference to the accompanying drawings.

In the following description, like drawing reference numerals are used for like elements, even in different drawings. The matters defined in the description, such as detailed construction and elements, are provided to assist in a comprehensive understanding of the exemplary embodiments. However, it is apparent that the exemplary embodiments can be practiced without those specifically defined matters. Also, well-known functions or constructions are not described in detail since they would obscure the description with unnecessary detail.

The exemplary embodiments of the present disclosure may be diversely modified. Accordingly, specific exemplary embodiments are illustrated in the drawings and are described in detail in the detailed description. However, it is to be understood that the present disclosure is not limited to a specific exemplary embodiment, but includes all modifications, equivalents, and substitutions without departing from the scope and spirit of the present disclosure. Also, well-known functions or constructions are not described in detail since they would obscure the disclosure with unnecessary detail.

The terms "first", "second", etc. may be used to describe diverse components, but the components are not limited by the terms. The terms are only used to distinguish one component from the others.

The terms used in the present application are only used to describe the exemplary embodiments, but are not intended to limit the scope of the disclosure. The singular expression also includes the plural meaning as long as it does not differently mean in the context. In the present application, the terms "include" and "consist of" designate the presence of features, numbers, steps, operations, components, elements, or a combination thereof that are written in the specification, but do not exclude the presence or possibility of addition of one or more other features, numbers, steps, operations, components, elements, or a combination thereof.

In the exemplary embodiment of the present disclosure, a "module" or a "unit" performs at least one function or operation, and may be implemented with hardware, software, or a combination of hardware and software. In addition, a plurality of "modules" or a plurality of "units" may be integrated into at least one module except for a "module" or a "unit" which has to be implemented with specific hardware, and may be implemented with at least one processor.

Hereinafter, the present disclosure will be described in detail with reference to the accompanying drawings.

FIG. 1 is a block diagram to illustrate a configuration of a display apparatus according to an exemplary embodiment.

Referring to FIG. 1, the display apparatus 100 includes an image inputter 110, a display panel 120, a panel driver 130, and a processor 140.

The image inputter 110 receives an input of an image. Specifically, the image inputter 110 may receive an input of an image from various external devices such as an external storage medium, a broadcasting station, a web server, etc. The inputted image may be one of a single view image, that is, a two-dimensional (2D) image, a stereo image, and a multi-view image.

The display panel 120 includes a plurality of pixels and displays the inputted image by allowing the plurality of pixels to emit light on a pixel basis. Herein, the plurality of pixels may be implemented by using a self-emission element which emits light by itself, such as an organic light emitting diode (OLED), a plasma display panel (PDP), a light emitting diode (LED), etc., but is not limited thereto. Any display panel configured to directly control the brightness or luminance of respective pixels may be applied without limitation.

The panel driver 130 drives the display panel 120. Specifically, the panel driver 130 may control the light emitting state of each of the plurality of pixels of the display panel 120 to display an image under the control of the processor 140.

The processor 140 may identify a grayscale characteristic of each of the plurality of pixels and recognize the plurality of pixels as at least two groups based on the grayscale characteristic. Then, the processor 140 may apply different gamma tables to the at least two groups of the plurality of pixels to adjust brightness of the image.

Figure 2:
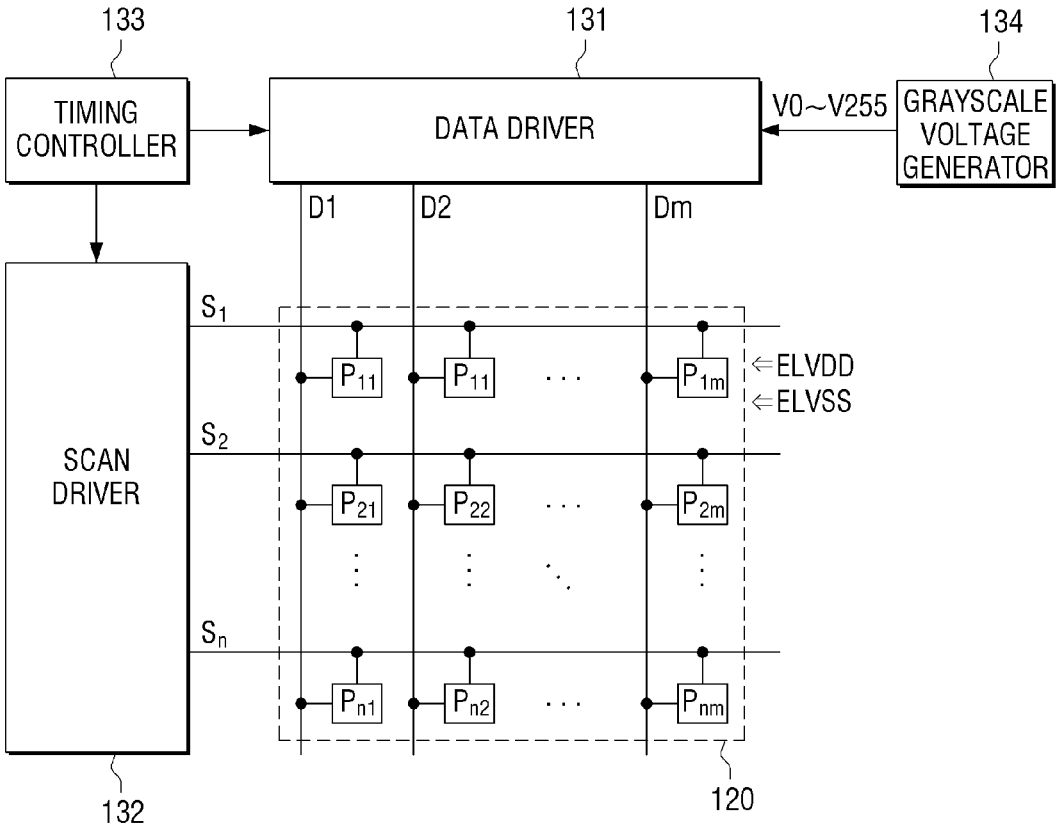
FIG. 2 is a block diagram showing a detailed configuration of a panel driver according to an exemplary embodiment.

FIG. 2 is a block diagram showing a detailed configuration of a panel driver according to an exemplary embodiment.

Referring to FIG. 2, the panel driver 130 according to an exemplary embodiment includes a data driver 131, a scan driver 132, and a timing controller 133.

The display panel 120 has the plurality of pixels Pij arranged therein, and each of the pixels Pij may include a self-emission element which emits light in response to flow of current and a driving transistor which controls the current to be supplied to the self-emission element. The self-emission element may be an organic light emitting diode, and the current may be supplied to the self-emission element from a voltage supply terminal (e.g., ELVDD).

In addition, the display panel 120 may include n number of scan lines S1, S2, S3, . . . , Sn arranged in the row direction to transmit scan signals, and m number of data lines D1, D2, D3, . . . , Dm arranged in the column direction to transmit data signals.

In addition, the display panel 120 may receive a first voltage as driving power and receive a second voltage as base power from a voltage source under the control of the processor 140. Thus, the display panel 120 may be driven by the processor 140. Herein, the first voltage may be represented by an ELVDD and the second voltage may be represented by an ELVSS. For example, when current flows to the organic light emitting diode through the scan signals, the data signals, driving power (ELVDD), and base power (ELVSS), the display panel 120 displays an image by emitting light according to the amount of the current.

The data driver 131 may receive video signals having red, blue, and green components (R, G, B data) and generate data signals based on the received video signals. In addition, the data driver 131 may be connected with the data lines D1, D2, D3, . . . , Dm of the display panel 120 to apply the generated data signals to the display panel 120.

The scan driver 132 may generate scan signals. The scan driver 132 may be connected with the scan lines S1, S2, S3, . . . , Sn and transmit the scan signals to a corresponding row of the display panel 120. The data signals outputted from the data driver 131 may be transmitted to one or more pixels of the display panel 120 to which the scan signals are transmitted.

The timing controller 133 may receive an input signal (IS), a horizontal synchronization signal (Hsync), a vertical synchronization signal (Vsync), and a main clock signal (MCLK), from external sources, generate a video data signal, a scan control signal, a data control signal, a light emission control signal, and provide the signals to the display panel 120, the data driver 131, and the scan driver 132.

A grayscale voltage generator 134 generates a plurality of grayscale voltages (V0 to V255), and supplies the grayscale voltages to the data driver 131.

The pixel Pij includes an organic light emitting diode (OLED), and is located at the intersection of the scan lines S1, S2, . . . , Sn and the data lines D1, D2, . . . , Dm. The pixel Pij will be explained in detail below with reference to FIG. 3.

Figure 3:
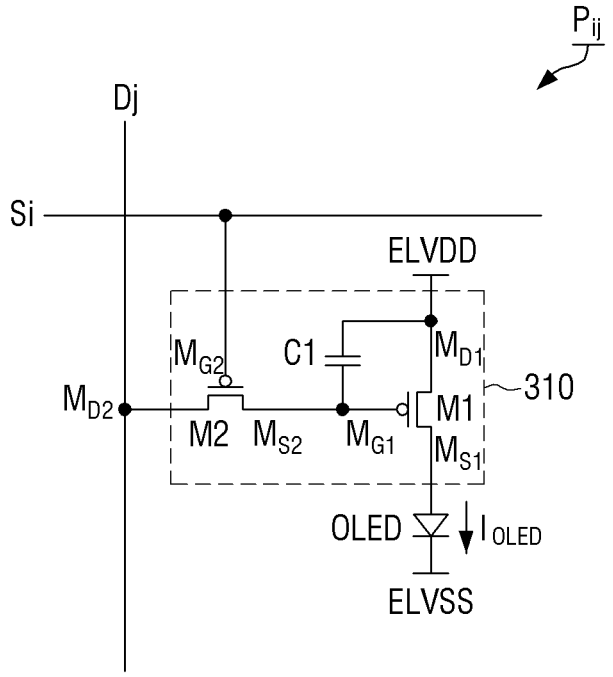
FIG. 3 is a circuit diagram showing a pixel structure according to an exemplary embodiment.

FIG. 3 is a circuit diagram showing a pixel structure according to an exemplary embodiment.

However, the pixel provided in the display panel according to an exemplary embodiment is not limited to the exemplary embodiment of FIG. 3.

The pixel according to an exemplary embodiment may be implemented by using an OLED as a light emitting element. The OLED receives a driving current outputted from a pixel circuit and emits light, and the brightness of light emitted from the OLED varies depending on the level of the driving current.

The pixel circuit 310 may include a capacitor C1, a driving transistor M1, and a switching transistor M2. The driving transistor M1 includes a first terminal $M_{D1}$ which is supplied with a high power voltage (ELVDD), a second terminal $M_{S1}$ which is connected to an anode of the OLED, and a gate terminal $M_{G1}$ which is connected to a second terminal $M_{S2}$ of the scan transistor M2. The anode of the OLED is connected to the second terminal $M_{S1}$ of the driving transistor M1, and a cathode of the OLED is connected to a low power voltage (ELVSS).

The switching transistor M2 includes a first terminal $M_{D2}$ which is connected to a data line Dj, the second terminal $M_{S2}$ which is connected to a gate terminal $M_{G1}$ of the driving transistor M1, and a gate terminal $M_{G2}$ which is connected to a scan line Si. The capacitor C1 is connected between the gate terminal $M_{G1}$ and the first terminal $M_{D1}$ of the driving transistor M1.

In response to a scan signal that turns on the scan transistor M2 being applied to the terminal gate $M_{G2}$ of the scan transistor M2 through the scan line Si, the data voltage is applied to the gate terminal $M_{G1}$ of the driving transistor M1 and the first terminal of the capacitor C1 through the switching transistor M2. While an effective data voltage is applied through the data line Dj, the storage capacitor C1 is charged with a level of voltage corresponding to the data voltage. The driving transistor M1 generates a driving current ($I_{OLED}$) according to the voltage level of the data voltage, and outputs the driving current to the OLED.

The OLED may receive the driving current ($I_{OLED}$) from the pixel circuit 310, and emit light of brightness corresponding to the data voltage.

According to an exemplary embodiment, the processor 140 may divide a corresponding image into a plurality of areas based on the grayscale characteristic of the inputted image, and control the panel driver 130 to individually adjust the display brightness (or output brightness) of at least one of the plurality of areas.

Specifically, the processor 140 may convert an inputted analogue image into a digital image of a predetermined bit (for example, 6 bits or 8 bits), and divide the corresponding image into a plurality of areas based on the grayscale characteristic of the converted digital image. Herein, the grayscale refers to change in concentration of color, that is, refer to subdividing a bright part and a dark part of color into several stages. When brightness and darkness of an image are further subdivided, change in color is naturally expressed. In this case, the grayscale is expressed as good.

Specifically, the processor 140 may apply a gamma table (or a gamma curve) of a different form to each of the plurality of divided areas.

In particular, the processor 140 may apply, to each of the plurality of areas, a separate gamma table (or gamma curve) in which at least one of a minimum brightness level and a maximum brightness level is different, and control to individually adjust the display brightness of each area according to the applied gamma table. Herein, the gamma table (or gamma curve) refers to a table indicating a relationship between a grayscale and display brightness of an image when the display apparatus 100 emits light at a maximum brightness level. That is, the processor 140 may variously adjust an inter-grayscale brightness mapping gap by applying, to each of the plurality of areas forming a single image, a separate gamma table having a different dynamic range which is determined by a minimum brightness level and a maximum brightness level.

For example, the processor 140 may individually control the display brightness of each of the areas by applying, to a first area having a relatively low grayscale, a first gamma table having relatively low minimum and maximum brightness levels, and applying, to a second area having a relatively high grayscale, a second gamma table having relatively high minimum and maximum brightness levels.

In this case, the processor 140 may apply a complete separate gamma table to each of the plurality of areas, but may apply to connect a gamma table applied to one area and a gamma table applied to a neighboring area.

For example, when the plurality of areas include the first area and the second area, the processor 140 may apply the first gamma table to the first area, and apply a completely separate gamma table different from the first gamma table to the second area.

In another example, when the first gamma table is applied to the first area, the second gamma table may be applied to connect with the first gamma table at the end grayscale and the corresponding display brightness. This will be understood well with reference to the drawing.

In addition, the processor 140 may divide at least one of the plurality of areas into a plurality of subareas based on a grayscale distribution of pixels forming the corresponding one area, and may control to individually adjust the display brightness of at least one of the plurality of subareas. For example, when the image represents stars twinkling in the night sky, the background area of the night sky is divided into a single area, but the area of the twinkling stars may be divided into a plurality of subareas in the corresponding area. This is because there is a big difference in the grayscale between the background area of the night sky and the area of the twinkling stars.

Meanwhile, the processor 140 may analyze a grayscale histogram of an inputted image in order to divide the inputted image into a plurality of areas, and may divide the entire grayscale section of the inputted image into a plurality of grayscale sections based on the grayscale distribution of pixels forming the inputted image. Next, the processor 140 may apply a separate gamma table to at least one area corresponding to at least one of the plurality of grayscale sections, and control to individually adjust the display brightness of the corresponding area.

Specifically, the processor 140 may divide the entire grayscale section of the inputted image into the plurality of grayscale sections with reference to a grayscale value (or a grayscale section) at which the pixel distribution increases or decreases by more than a predetermined threshold value in the grayscale histogram of the inputted image. The grayscale histogram recited herein refers to a graph indicating the grayscale distribution of pixels forming an image. For example, the x-axis of the graph may indicate a grayscale level of an inputted image, and the grayscale level of the inputted image is divided into 256 stages, that is, 0 to 255 stages. The y-axis of the graph may indicate the number of pixels (dots). However, the grayscale level of the inputted image may be changed according to attributes or characteristics of the image.

In addition, the processor 140 may divide the inputted image into the plurality of areas according to a predetermined criterion, and control to individually adjust the display brightness of at least one of the plurality of areas based on the grayscale distribution of pixels forming the plurality of divided areas.

Specifically, the processor 140 may divide an inputted image frame into a plurality of pixel areas having a predetermined size, and divide the inputted image frame into a plurality of areas based on the grayscale distribution of pixels forming each of the pixel areas in order to individually adjust the display brightness. Specifically, the processor 140 may group the plurality of pixel areas to the plurality of areas based on the grayscale characteristic such as a maximum grayscale value, an average grayscale value, or a minimum grayscale value of each of the pixel areas.

In addition, the processor 140 may divide the inputted image into the plurality of areas according to the content attribute of the image. For example, the processor 140 may divide an object area included in each image into a plurality of areas based on metadata information on a plurality of objects included in the image.

However, the method for dividing the inputted image into the plurality of areas is not limited to the above-described methods, and any method for dividing the area based on the grayscale of an image may be applied without limitation.

In addition, the processor 140 may control to individually adjust the display brightness of an object area based on the grayscale characteristic of an object area that satisfies a predetermined condition from among the plurality of object areas forming the inputted image. The object area satisfying the predetermined condition may correspond to a user's interest object area (for example, a recent message area, a notification message display area, etc. from among a plurality of message areas), but is not limited thereto. For example, when an image includes a person and a background, the area of the image in which the subject is present may be set as an interest object area.

However, the divided area may be an object unit as described above, but is not limited to this. For example, an area including a single object and a neighboring object thereof may be an area for individually adjusting brightness.

Specifically, the processor 140 may apply a gamma table corresponding to a corresponding object area based on the grayscale characteristic of the corresponding object area, such as a maximum grayscale, an average grayscale, a minimum grayscale, etc.

In addition, the processor 140 may divide a single object into a plurality of subsidiary areas (i.e., subareas) based on the grayscales of a plurality of pixels forming the object, and may apply a separate gamma table to each of the subareas. For example, when the object is a mountain, and the middle and lower area and the upper area of the mountain have different grayscales, the first gamma table may be applied to the middle and lower area of the mountain, and the second gamma table may be applied to the upper area of the mountain.

According to another exemplary embodiment, the processor 140 may apply the gamma table in a different form in each operation mode based on the operation mode of the display apparatus 100.

Specifically, when the display apparatus 100 is operated in a low power mode (e.g., power saving mode), the processor 140 may adjust the inter-grayscale brightness mapping gap by rescaling at least one grayscale section of an image based on a maximum brightness level pre-set in the low power mode. The processor 140 may reduce the total number of bits used in expressing the image by adjusting the grayscale gap mapped onto the brightness to be wide according to a target reduction rate in the low power mode.

According to another exemplary embodiment, the processor 140 may analyze the surrounding environment of the display apparatus 100, and adjust brightness based on the surrounding environment. For example, when the display maximum brightness level is changed according to ambient illuminance, an adjusted gamma table may be applied to the inter-grayscale brightness mapping gap to adjust brightness to correspond to the changed maximum brightness level. In another example, when a gamma table is pre-set according to ambient illuminance, a gamma table appropriate to ambient illuminance may be selectively applied to adjust brightness.

Figure 4:
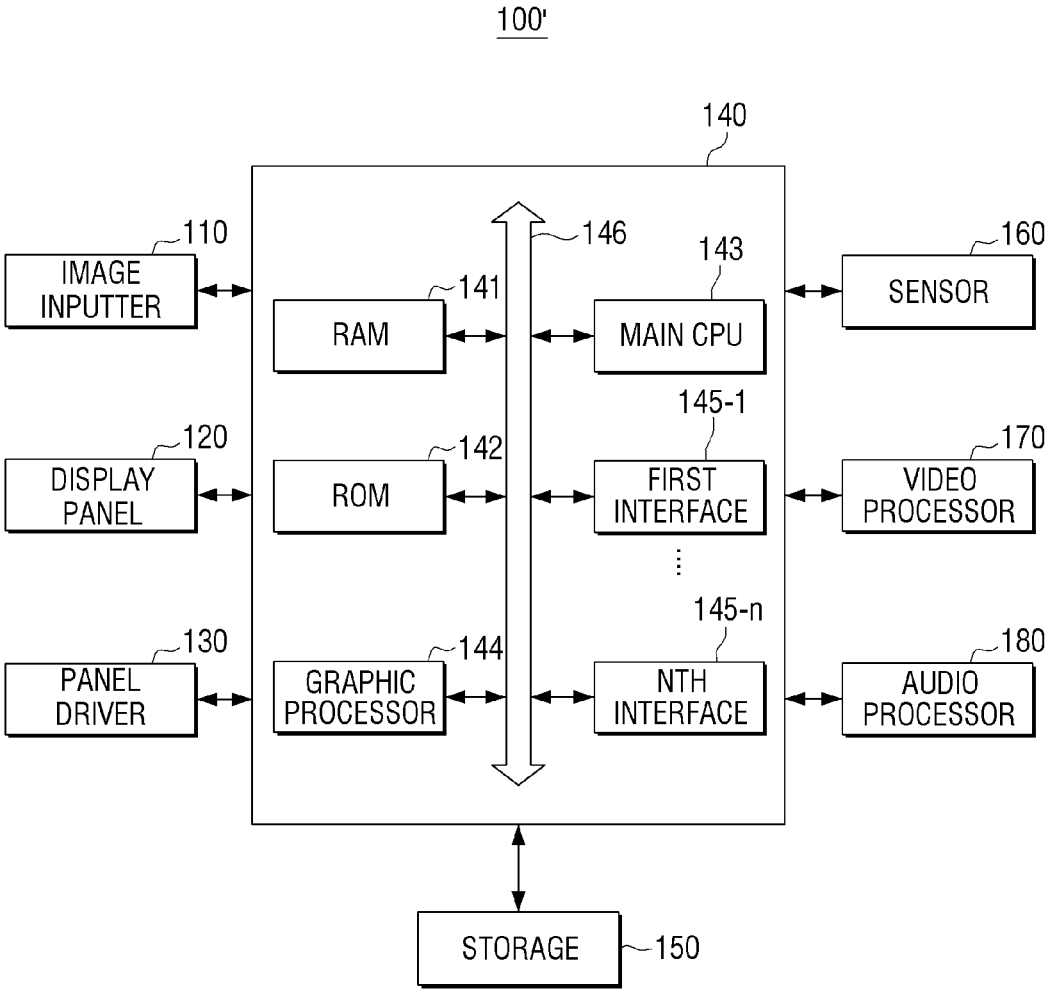
FIG. 4 is a block diagram showing a detailed configuration of a display apparatus shown in FIG. 1.

FIG. 4 is a block diagram showing the detailed configuration of the display apparatus shown in FIG. 1. Referring to FIG. 4, the display apparatus 100' includes an image inputter 110, a display panel 120, a panel driver 130, a processor 140, a storage 150, a sensor 160, a video processor 170, and an audio processor 180. In FIG. 4, the elements shown in FIG. 1 will not be described in detail.

The processor 140 controls the overall operations of the display apparatus 100'.

Specifically, the processor 140 may include a random access memory (RAM) 141, a read only memory (ROM) 142, a central processing unit (CPU) 143, a graphic processor 144, first to n-th interfaces 145-1 to **145-*n*, and a bus 146**.

The RAM 141, the ROM 142, the CPU 143, the graphic processor 144, and the first to n-th interfaces 145-1 to **145-*n* may be connected with one another via the bus 146**.

The first to n-th interfaces 145-1 to **145-*n* may be connected with the above-described various elements. One of the interfaces 145-1 to 145-*n*** may be a network interface which is connected with an external device via a network.

The CPU 143 may access the storage 150 and perform booting using an operating system (O/S) stored in the storage 150. In addition, the CPU 143 may perform various operations using various programs, content, data, etc. which are stored in the storage 150.

The ROM 142 may store a set of instructions for booting a system. In response to a turn on command being inputted and power being supplied, the CPU 143 may copy the O/S stored in the storage 150 into the RAM 141 according to a command stored in the ROM 142, and boot the system by executing the O/S. In response to the booting being completed, the CPU 143 may copy various application programs stored in the storage 150 into the RAM 141, and perform various operations by executing the application programs copied into the RAM 141.

The graphic processor 144 may generate a screen including various objects such as an icon, an image, a text, etc., for example, a screen including a pointing object, using a calculator and a renderer. The calculator may calculate attribute values of objects to be displayed according to a layout of the screen, such as a coordinate value, a shape, a size, a color, etc., based on a received control command. The renderer may generate the screen of various layouts including objects based on the attribute values calculated by the calculator.

Figure 5:
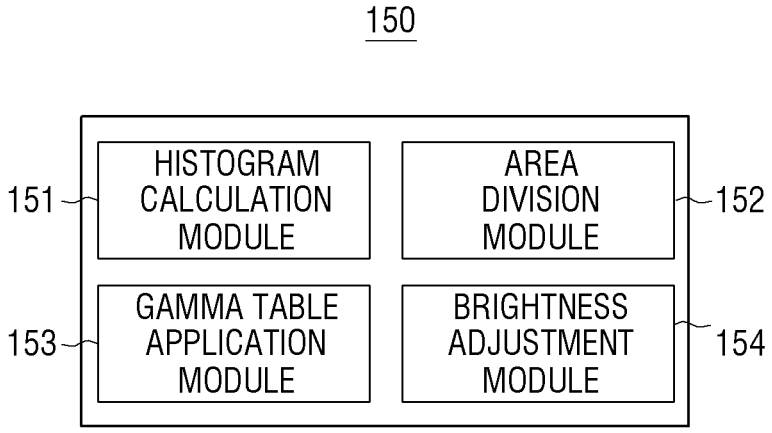
FIG. 5 is a block diagram showing a configuration of a storage according to an exemplary embodiment.

The above-described operations of the processor 140 may be performed by a program stored in the storage 150 as shown in FIG. 5.

The storage 150 may store an O/S software module that drives the display apparatus 100', and a variety of data such as various multimedia contents.

In particular, as shown in FIG. 5, the storage 150 may store programs that provide functions according to an exemplary embodiment, such as a histogram calculation module 151, an area division module 152, a gamma table application module 153, and a brightness adjustment module 154.

The processor 140 may analyze respective input image frames using the histogram calculation module 151 and calculate a grayscale histogram corresponding to each of the image frames. The grayscale histogram recited herein is a graph indicating the grayscale distribution of the pixels forming the image frame as described above.

Next, the processor 140 may divide the image frame into a plurality of areas based on the calculated grayscale histogram using the area division module 152. For example, the processor 140 may divide the grayscale section of the image frame into a plurality of sections with reference to a grayscale at which the number of pixels (dots) increases or decreases by more than a predetermined threshold value in the grayscale histogram.

Next, the processor 140 may apply a gamma table corresponding to each of the plurality of areas using the gamma table application module 153. However, the number of the plurality of areas and the number of the gamma tables applied may not necessarily be the same. For example, two areas may be combined and a single gamma table may be applied to the combined area.

Thereafter, the processor 140 may individually control the brightness of each of the areas according to the gamma table applied to each area using the brightness adjustment module 154.

In addition, the storage 150 may store various gamma tables. In this case, the processor 140 may acquire a gamma table corresponding to the grayscale distribution of each of the areas from among the gamma tables stored in the storage 150, and may use the gamma table in adjusting the brightness of each of the areas. However, according to circumstances, the storage 150 may store only a basic gamma table, and may adjust the form of the basic gamma table in real time according to a lookup table (LUT) or a calculation equation, and acquire various gamma tables corresponding to the respective areas.

In addition, the storage 150 may sample a plurality of images, and store gamma tables corresponding to the respective sample images of various types. In this case, the processor 140 may understand the grayscale distribution type of an inputted image, and then directly apply a gamma table pre-defined for the corresponding type. For example, the processor 140 may calculate a gamma table corresponding to an image type in which 50% of the pixels are distributed between grayscales 0 and 100, 30% of the pixels are distributed between grayscales 101 and 200, and 20% of the pixels are distributed between grayscales 201 and 255 in advance according to an exemplary embodiment, and then understand the type of an inputted image, and directly apply a corresponding gamma table.

The sensor 160 may detect a surrounding environment. The sensor 160 may detect at least one of various characteristics such as illuminance, intensity, color, entering direction, entering area, and distribution of light. According to an exemplary embodiment, the sensor 160 may be an illuminance sensor, a temperature sensor, a light sensing layer, or a camera.

The video processor 170 may process video data. The video processor 170 may perform various image processing operations such as decoding, scaling, noise filtering, frame rate conversion, and resolution conversion with respect to the video data.

The audio processor 180 may process audio data. The audio processor 180 may perform various processing operations such as decoding, amplification, and noise filtering with respect to the audio data.

Figure 6A:
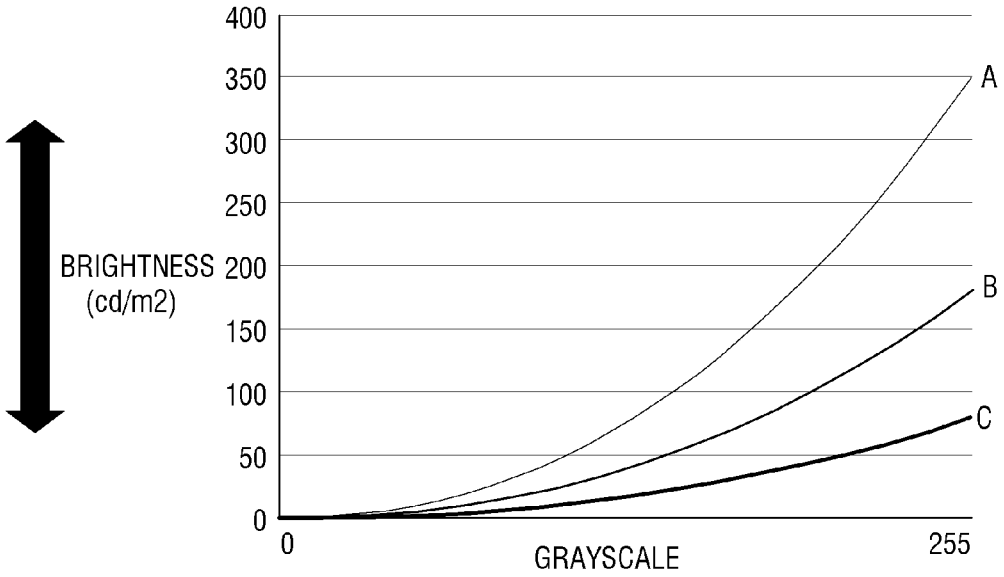
FIGS. 6A and 6B are views showing forms of gamma tables according to various exemplary embodiments.
Figure 6B:
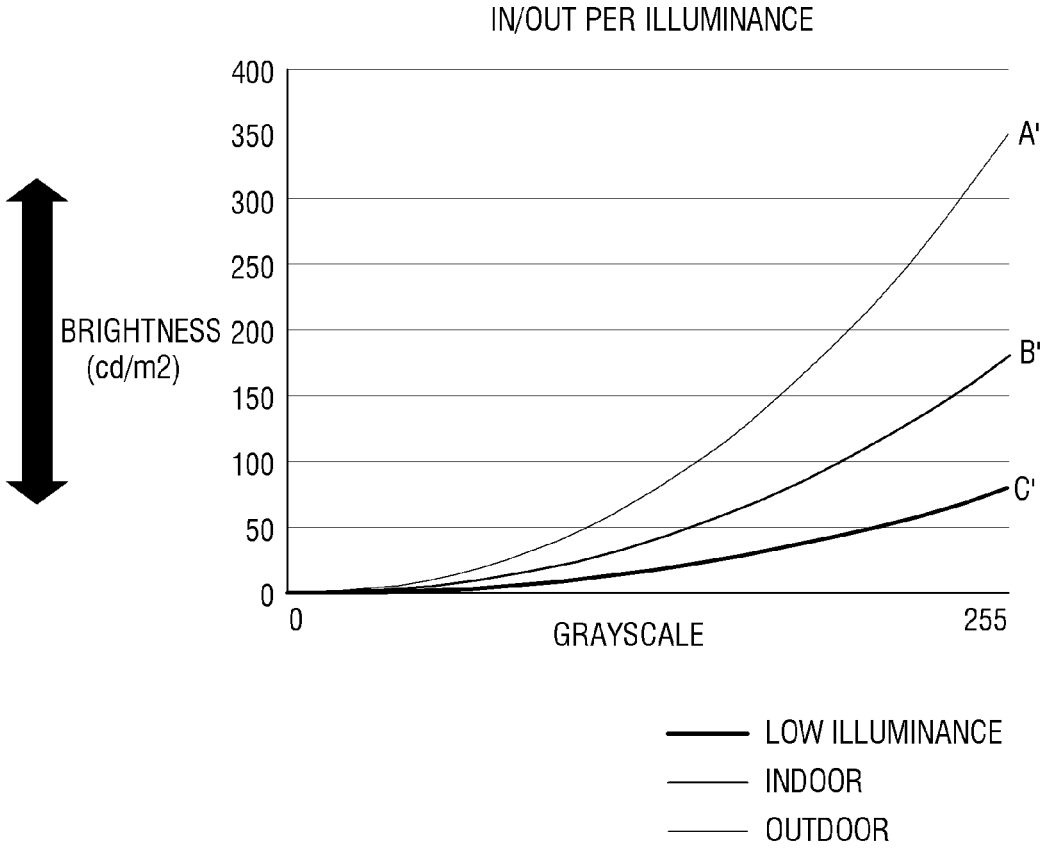

FIGS. 6A and 6B are views showing forms of gamma tables according to various exemplary embodiments.

FIG. 6A is a view showing various forms of gamma tables according to an exemplary embodiment.

The gamma table refers to a table indicating a relationship between a grayscale and display brightness of an image when the display apparatus 100 emits light at a maximum brightness level.

As shown in FIG. 6A, various gamma tables (table A to table C) having different maximum display brightness may be pre-stored in the storage 150, or may be generated in real time based on a basic gamma table (for example, table A).

FIG. 6B is a view showing various forms of gamma tables according to another exemplary embodiment.

As shown in FIG. 6, various different gamma tables (table A' to table C') pre-defined according to an environmental condition may be pre-stored in the storage 150. Table A' may be applied to an image that is captured indoor or in an indoor setting, and Table B' may be applied to an image that is captured outdoor or in an outdoor setting. Table C' may be applied to an image captured in a darker environment than the indoor environment in which Table B' is applied.

In addition, the display apparatus 100' may further include the audio processor 180 to process audio data, the video processor 170 to process video data, a camera to photograph a still image or a moving image under the control of the user, a microphone to receive a user voice or other sounds and convert the user voice or other sounds into audio data.

Hereinafter, a method for adjusting brightness according to an exemplary embodiment will be explained in detail with reference to the drawings.

Figure 7:
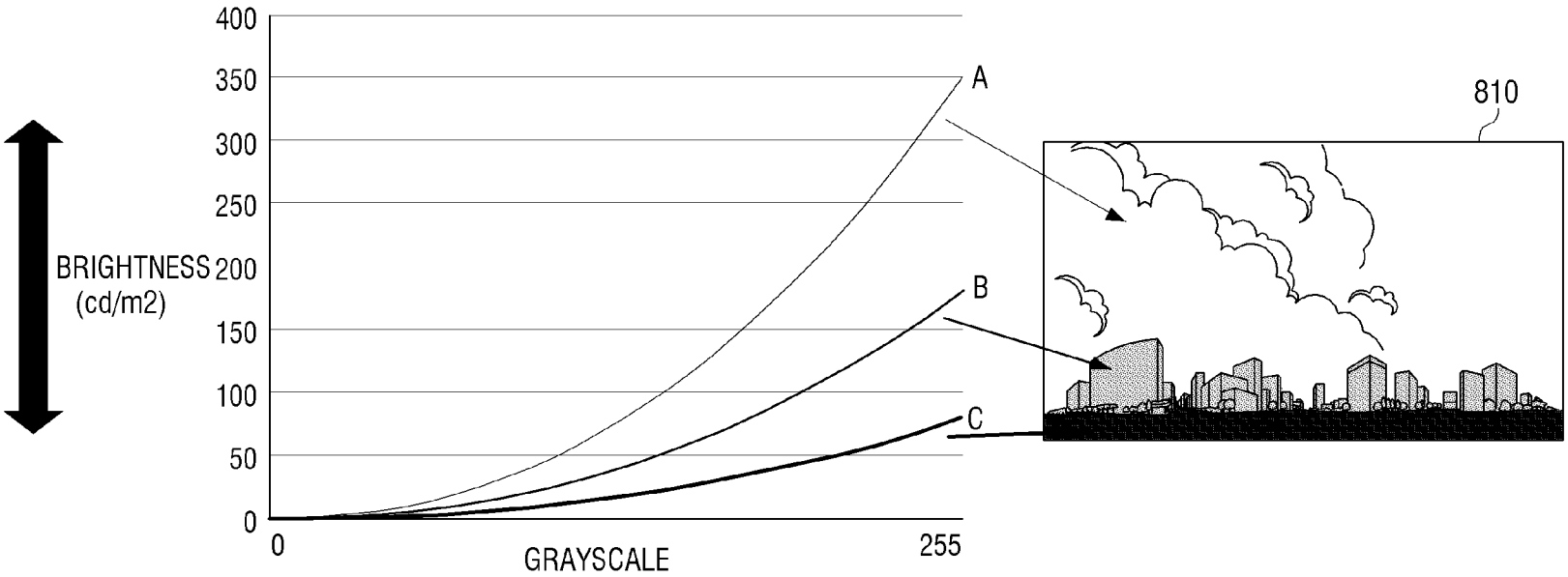
FIGS. 7 and 8 are views showing a brightness histogram according to an exemplary embodiment.

FIG. 7 is a view showing a brightness histogram according to an exemplary embodiment.

As shown in FIG. 7, the processor 140 may divide an image 810 into a plurality of areas based on the grayscale characteristic of the image 810, and individually adjust the display brightness of each of the plurality of areas. Specifically, the processor 140 may individually adjust the display brightness by applying a different gamma table to each of the plurality of areas as shown in FIG. 7.

Figure 8:
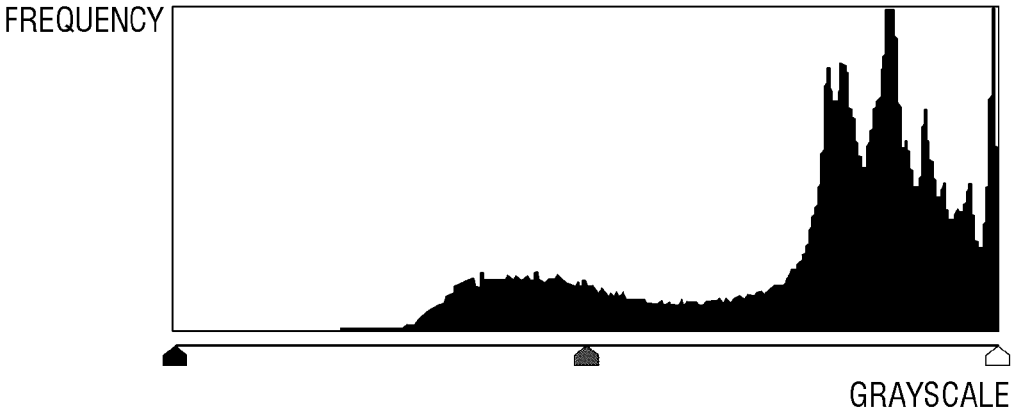

For example, when a brightness histogram of an inputted image frame has a shape shown in FIG. 8, the processor 140 may divide the entire grayscale section of the image frame into a plurality of grayscale sections with reference to a grayscale at which the number of pixels (dots) is changed to be more than a predetermined threshold value in the brightness histogram. For example, when the number of pixels is changed to be more than a predetermined threshold value at specific grayscale values (or grayscale areas) as shown in FIG. 8, the entire grayscale section may be divided into a plurality of grayscale sections with reference to the corresponding grayscale value (or grayscale area), and the image frame may be divided into a plurality of areas corresponding to the respective grayscale sections.

Figure 9A:
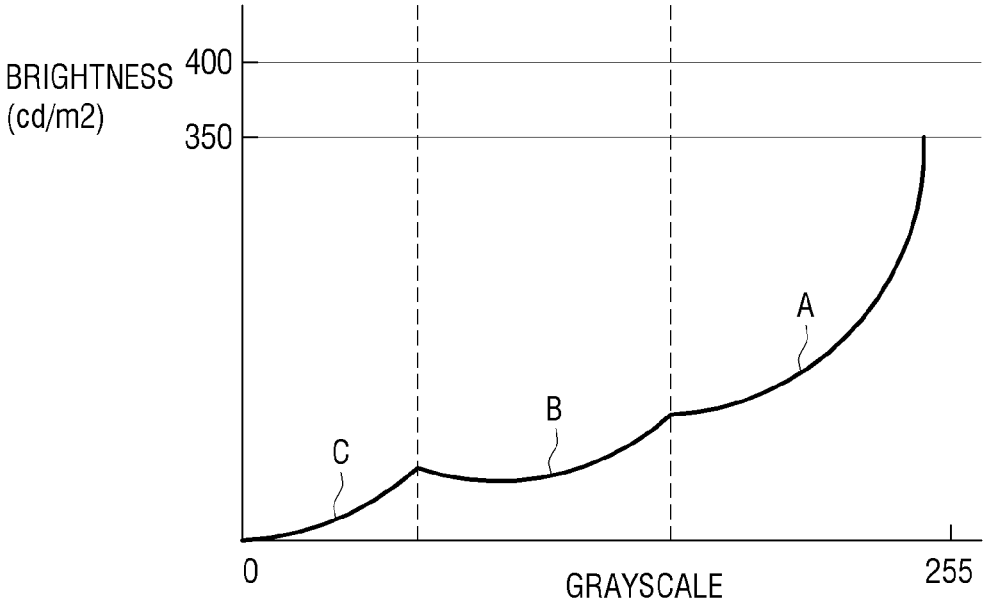
FIGS. 9A and 9B are views showing forms of gamma tables according to an exemplary embodiment.

Specifically, according to an exemplary embodiment, a different gamma table may be applied to each of the plurality of areas corresponding to the respective grayscale sections as shown in FIG. 9A. For example, a gamma table C may be applied to the first grayscale section which is the darkest area to adjust brightness, a gamma table B may be applied to the second grayscale section which is the middle-level brightness area to adjust brightness, and a gamma table A may be applied to the third grayscale section which is the brightest area to adjust brightness. That is, the gamma table C is applied to the first grayscale section, the gamma table B is applied to the second grayscale section from a display brightness point where the gamma table C ends, and the gamma table A is applied to the third grayscale section from a display brightness point where the gamma table B ends.

Figure 9B:
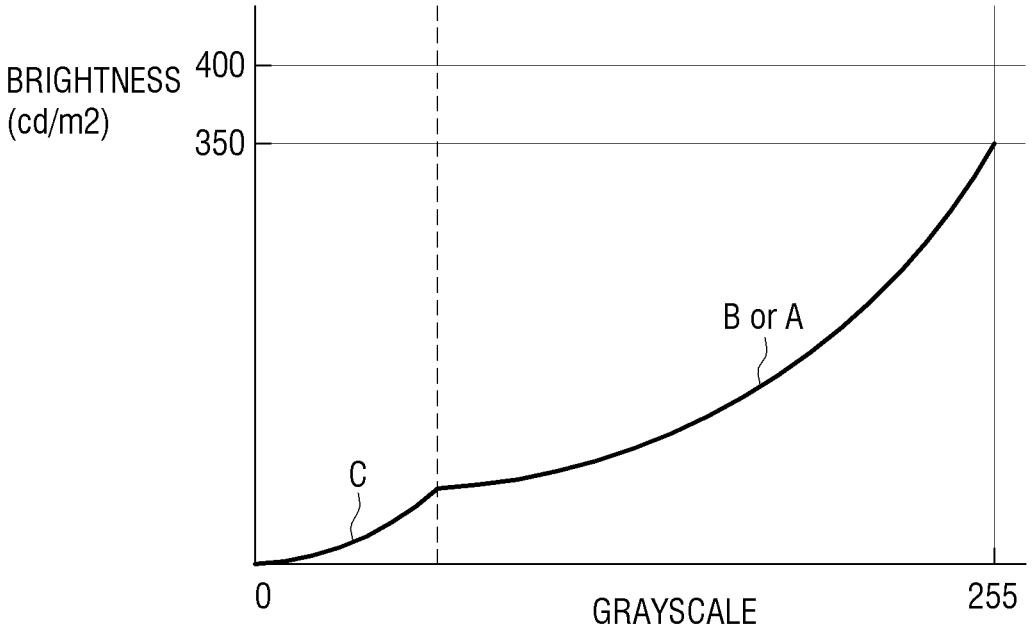

However, according to another exemplary embodiment, at least one of the plurality of areas corresponding to the respective grayscale sections may be combined, and a single gamma table may be applied to the combined area as shown in FIG. 9B. For example, as shown in FIG. 9B, the gamma table C may be applied to the first grayscale section to adjust the brightness, and the second grayscale section and the third grayscale section are combined and a single gamma table, that is, the gamma table B or C may be applied to the combined area to adjust the brightness. As described above, the gamma tables may be applied in various forms according to the characteristic of an image.

Figure 10A:
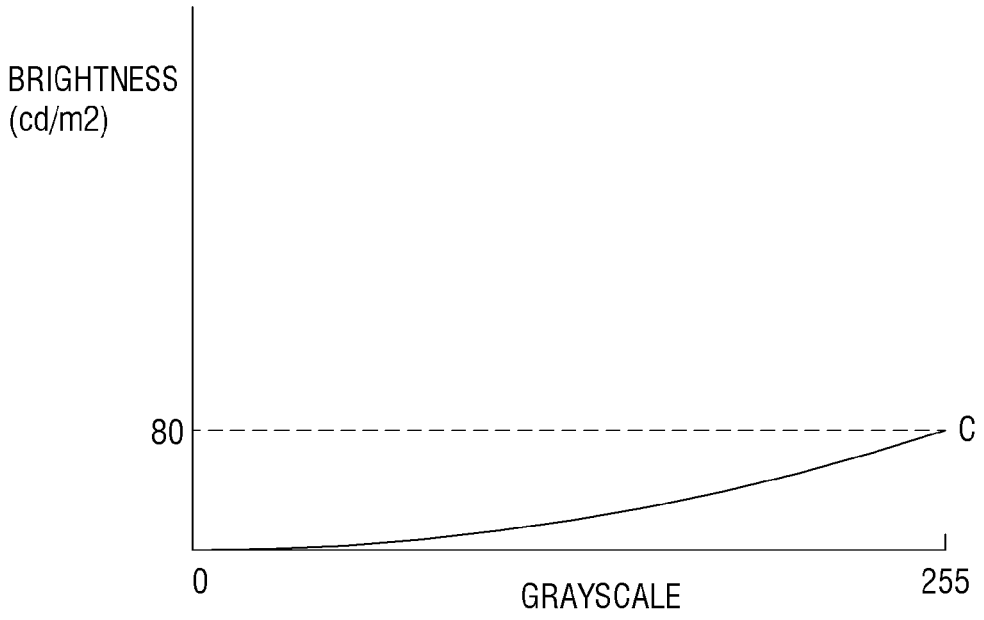
FIGS. 10A to 10C are views to illustrate a method for adjusting brightness for each area according to another exemplary embodiment.
Figure 10B:
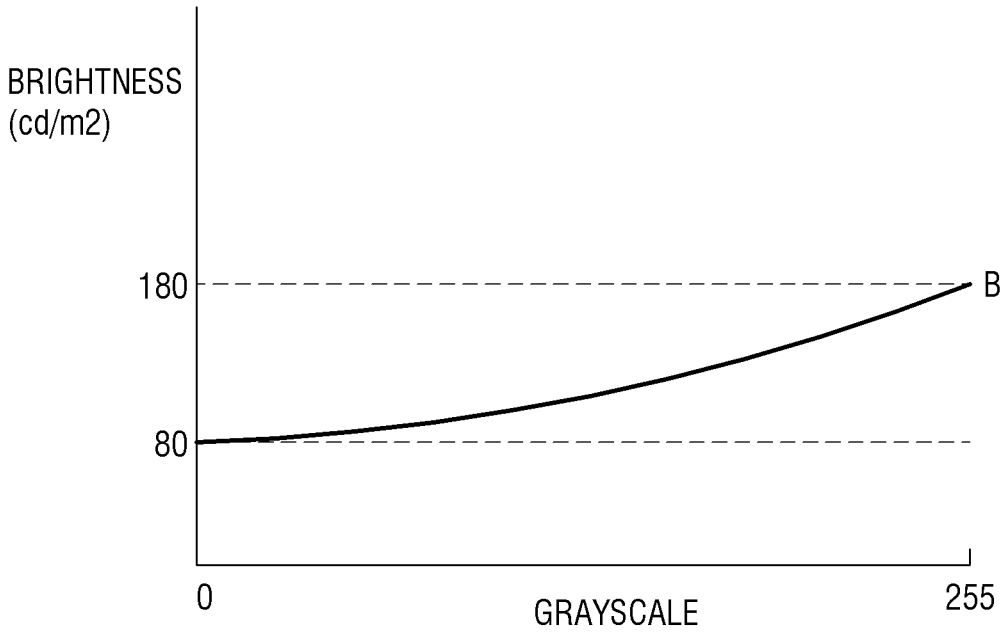
Figure 10C:
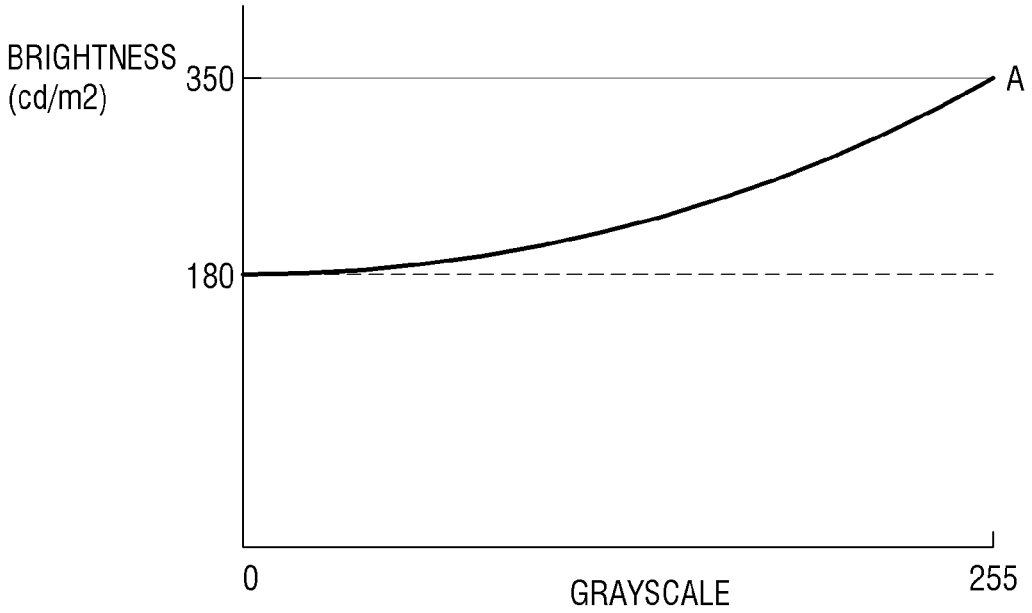

FIGS. 10A to 10C are views to illustrate a method for adjusting brightness of each area according to another exemplary embodiment.

Unlike in the exemplary embodiment shown in FIGS. 9A and 9B, the grayscale section of each of the plurality of areas may be rescaled to the entire grayscale section ranging from 0 to 255, and a gamma table corresponding to each area may be applied, so that an inter-grayscale brightness mapping gap can be adjusted.

For example, when the area to which the gamma table C is applied in FIG. 7 is a grayscale section ranging from 0 to 49, the corresponding grayscale section may be remapped or rescaled onto a grayscale section ranging from 0 to 255, and the gamma table C may be applied thereto as shown in FIG. 10A. For example, the inter-grayscale brightness mapping gap may be subdivided by mapping a grayscale section ranging from 0 to 1 out of the grayscale section ranging from 0 to 49 onto a grayscale section ranging from 0 to 4 (256/50=5.12), and mapping a grayscale section ranging from 1 to 2 onto a grayscale section ranging from 4 to 8. Regarding the other grayscale sections, the inter-grayscale brightness mapping gap may be subdivided by remapping in the same way as shown in FIGS. 10B and 10C. For example, when the area to which the gamma table B is applied in FIG. 7 is a grayscale section ranging from 50 to 170, the corresponding grayscale section may be remapped onto a grayscale section ranging from 0 to 255, and the gamma table B may be applied thereto as shown in FIG. 10B, and, when the area to which the gamma table A is applied in FIG. 7 is a grayscale section ranging from 171 to 255, the corresponding grayscale section may be remapped onto a grayscale section ranging from 0 to 255, and the gamma table A may be applied thereto as shown in FIG. 10C.

In another example, when the area to which the gamma table C is applied in FIG. 7 is a grayscale section ranging from 0 to 49, the corresponding grayscale section may be subdivided into grayscale sections 0 to 255, and the gamma table C may be applied thereto as shown in FIG. 10A. For example, the inter-grayscale brightness mapping gap may be subdivided by subdividing a grayscale section ranging from 0 to 1 out of the grayscale section ranging from 0 to 49 into grayscale sections 0 to 4, and subdividing a grayscale section ranging from 1 to 2 into grayscale sections 4 to 8. Regarding the other grayscale sections, the inter-grayscale brightness mapping gap may be subdivided by subdividing each of the grayscale sections in the same way as shown in FIGS. 10B and 10C. For example, when the area to which the gamma table B is applied in FIG. 7 is a grayscale section ranging from 50 to 170, the corresponding grayscale section may be subdivided into grayscale sections 0 to 255, and the gamma table B may be applied thereto as shown in FIG. 10B, and, when the area to which the gamma table A is applied in FIG. 7 is a grayscale section ranging from 171 to 255, the corresponding grayscale section may be subdivided into grayscale sections 0 to 255, and the gamma table A may be applied thereto as shown in FIG. 10C.

FIGS. 11A and 11B, FIGS. 12A and 12B, and FIGS. 13A to 13C are views to illustrate a method for adjusting brightness according to an image characteristic according to various exemplary embodiments.

Figure 11A:
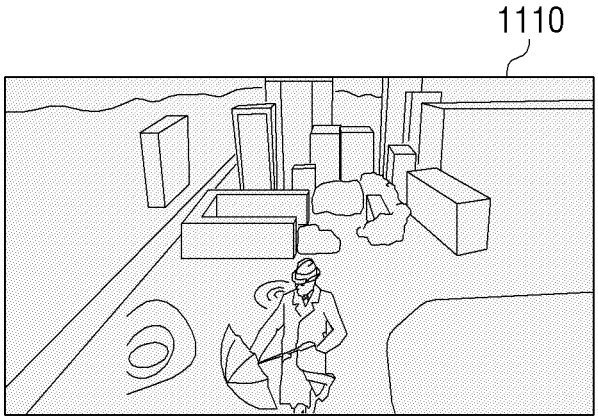
FIGS. 11A and 11B, FIGS. 12A and 12B, and FIGS. 13A to 13C are views to illustrate a method for adjusting brightness according to an image characteristic according to various exemplary embodiment.
Figure 11B:
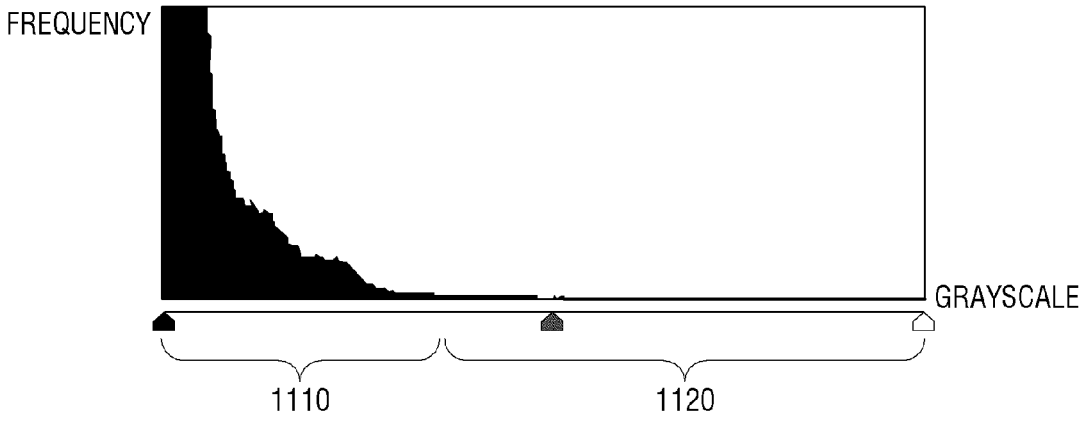

FIG. 11A illustrates an image 1110, most of which is formed of pixels having low grayscales, and the image may have a grayscale histogram as shown in FIG. 11B.

Figure 12A:
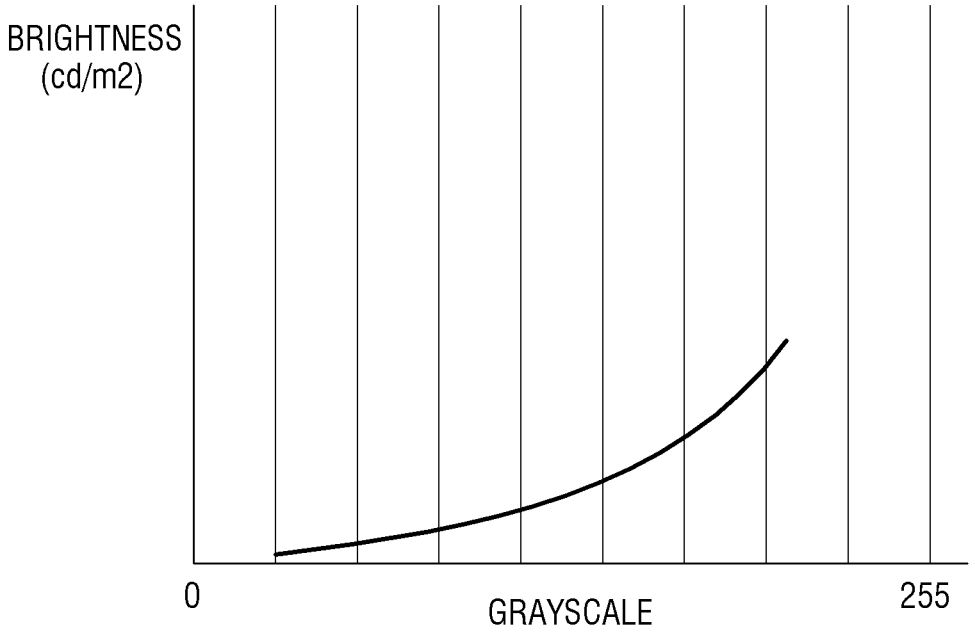

In this case, when a related-art method is used as shown in FIG. 12A, grayscales of a very bright range are not used, and thus the grayscales which are not used with reference to 8 bits are wasted and are not utilized. In FIG. 11B, there is no bright grayscale in the image. However, in FIG. 12A, very bright grayscales and very dark grayscales are not used for the convenience of explanation. Even when the very dark grayscales are not used as shown in FIG. 12A, the grayscales of the corresponding range are wasted and are not utilized.

Figure 12B:
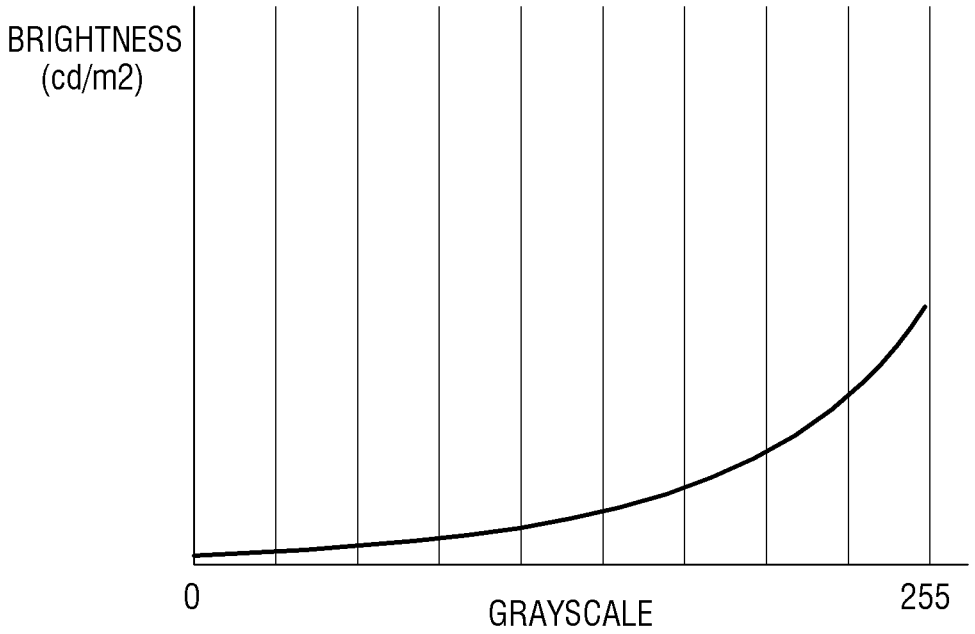

However, according to an exemplary embodiment, in order to achieve effective grayscale change, the display brightness is readjusted to be mapped onto the entire grayscale range of 0-255 as shown in FIG. 12B, and thus a dynamic range can be expanded. Accordingly, minute and soft grayscale change can be achieved in the corresponding grayscale section.

Figure 13A:
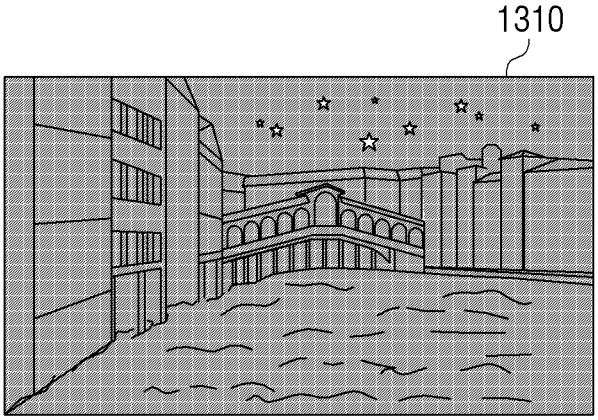
Figure 13B:
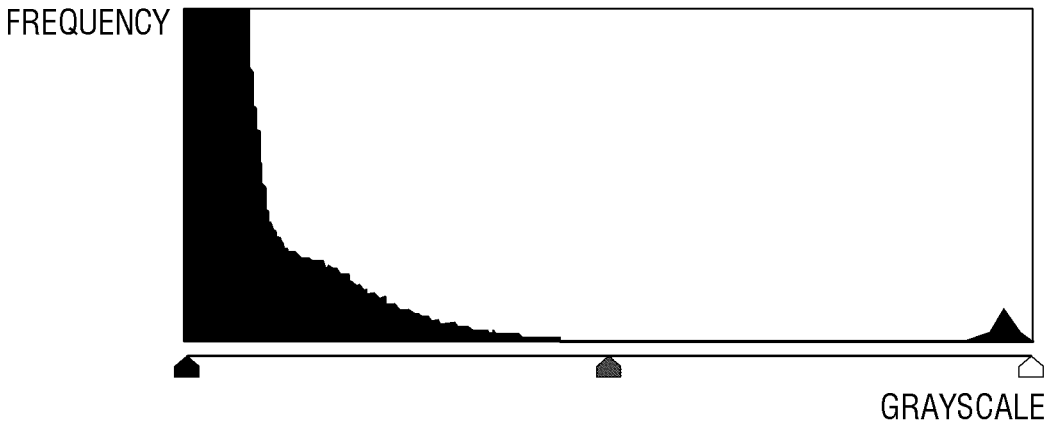

FIG. 13A illustrates an image 1310, most of which is formed of pixels having low grayscales, and a part of which is formed of pixels having high grayscales, and the image may have a grayscale histogram as shown in FIG. 13B.

Figure 13C:
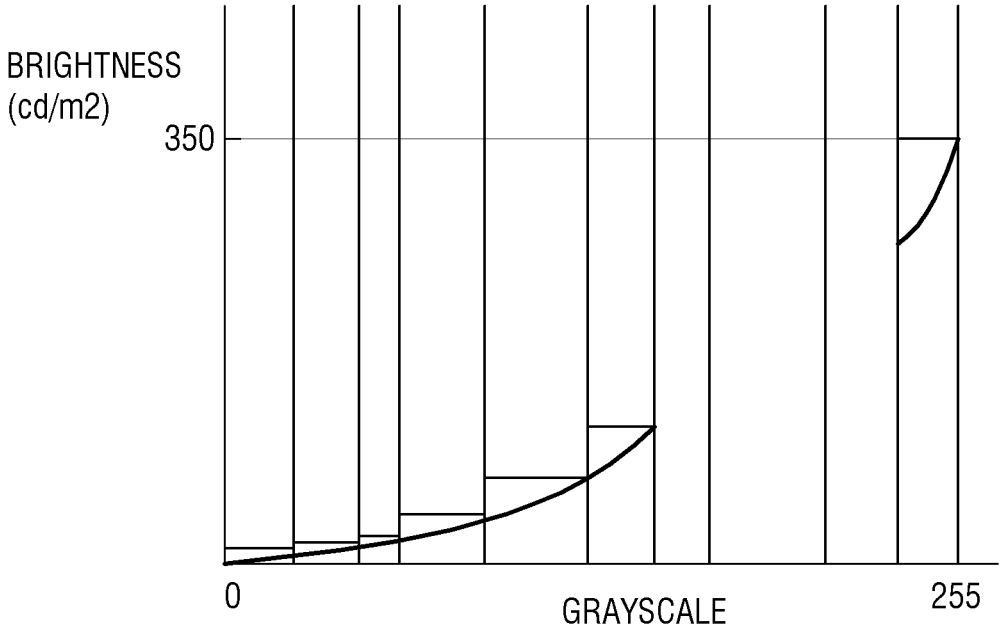

In this case, as shown in FIG. 13C, the inter-grayscale brightness mapping gap may be adjusted by applying a specific gamma table to a low grayscale section including most of the pixels, and applying a separate gamma table to a high grayscale section including some pixels. In this case, no gamma table may be applied to a grayscale section which does not include corresponding pixels.

Figure 14:
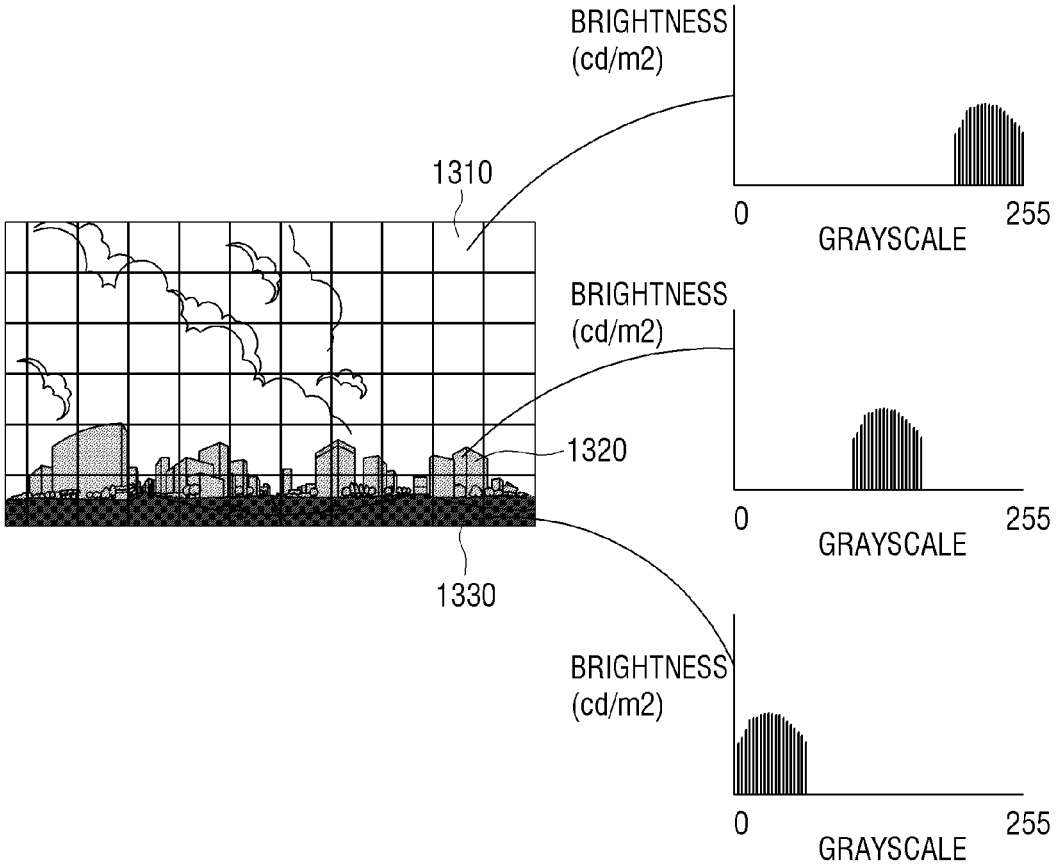
FIG. 14 is a view to illustrate a method for dividing an area according to another exemplary embodiment.

FIG. 14 is a view to illustrate a method for dividing an area according to another exemplary embodiment.

According to another exemplary embodiment, the processor 140 may divide an image into pixel areas having a predetermined size as shown in FIG. 14, and may divide the image into a plurality of areas based on the grayscale distribution of pixels forming each pixel area. Herein, the plurality of areas are individually controlled to adjust the brightness, and each of the areas may include a plurality of pixel areas.

Specifically, the processor 140 may group the pixel areas based on the pixel value of each of the pixel areas (for example, an average pixel value, a maximum pixel value, a minimum pixel value, etc.). Since the grouped pixel areas have similar pixel values, the grouped pixel areas may be set as a single area the brightness of which is adjusted according to a same gamma graph.

For example, in FIG. 14, a first pixel area 1310 is formed of pixels having very high grayscale values and is grouped to a first group, a second pixel area 1320 is formed of pixels having middle-level grayscale values and is grouped to a second group, and a third pixel area 1330 is formed of pixels having very low grayscale values and is grouped to a third group. The first to third groups form a first area to a third area which are to be controlled individually to adjust the brightness.

Figure 15:
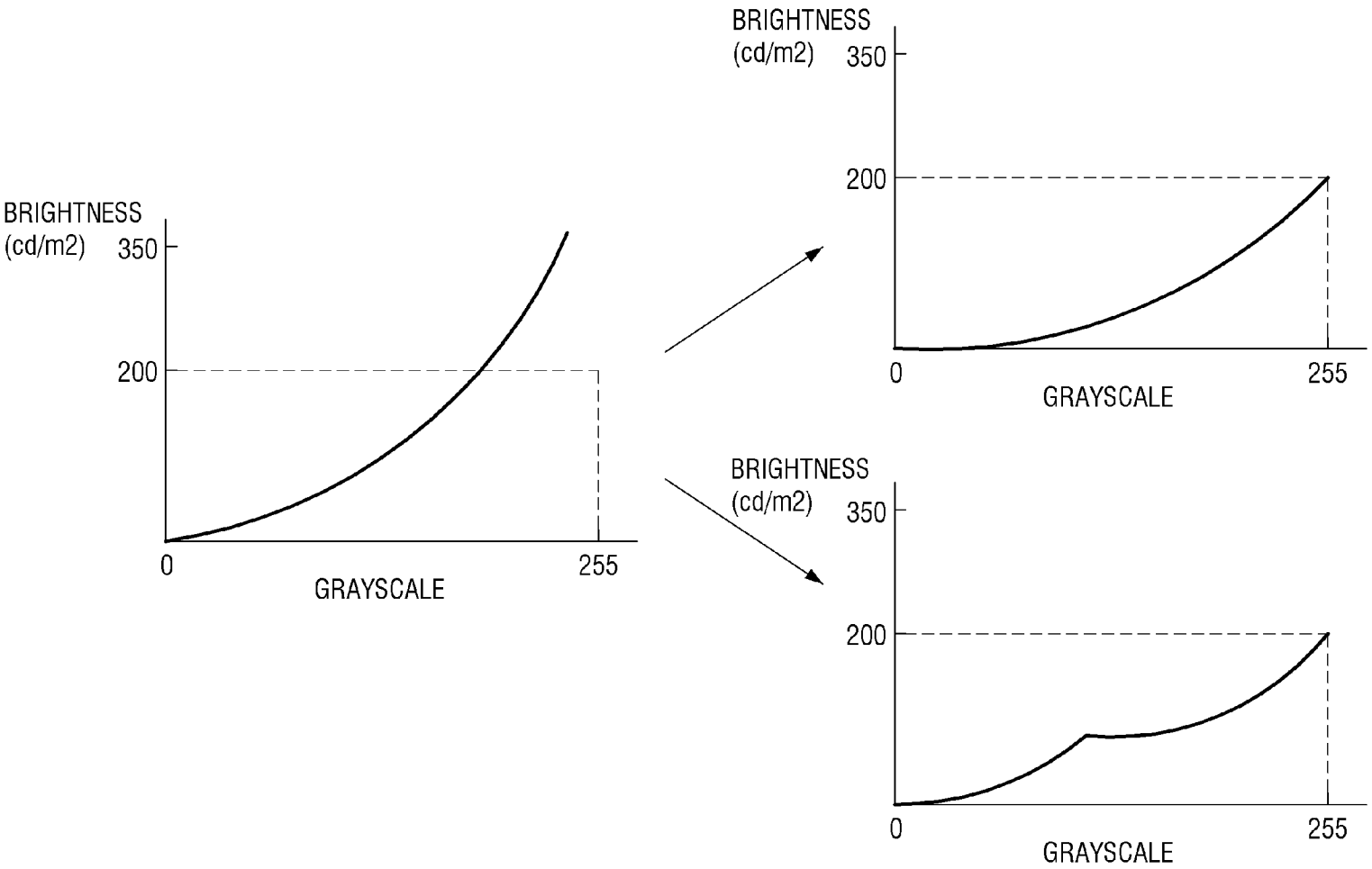
FIG. 15 is a view to illustrate a method for adjusting brightness in a low power mode according to another exemplary embodiment.

FIG. 15 is a view to illustrate a method for adjusting brightness in a low power mode according to another exemplary embodiment.

As shown in FIG. 15, when the display apparatus 100 is operated in the low power mode, the processor 140 may apply a gamma table which is an extended form of each of the grayscale sections forming the entire grayscale section of the image to at least one area based on a maximum brightness level pre-set in the low power mode.

For example, when the maximum brightness level in the low power mode is 200 candela per square meter (cd/m$^2$), a gamma graph having an adjusted brightness mapping gap may be applied in order to map all of the grayscale sections 0-255 onto brightness levels within 200 cd/m$^2$ as shown in the top right view.

However, in this case, as shown in the bottom right view, a separate gamma table may be applied to each of the plurality of grayscale sections to adjust the brightness mapping gap according to an exemplary embodiment.

Figure 16A:
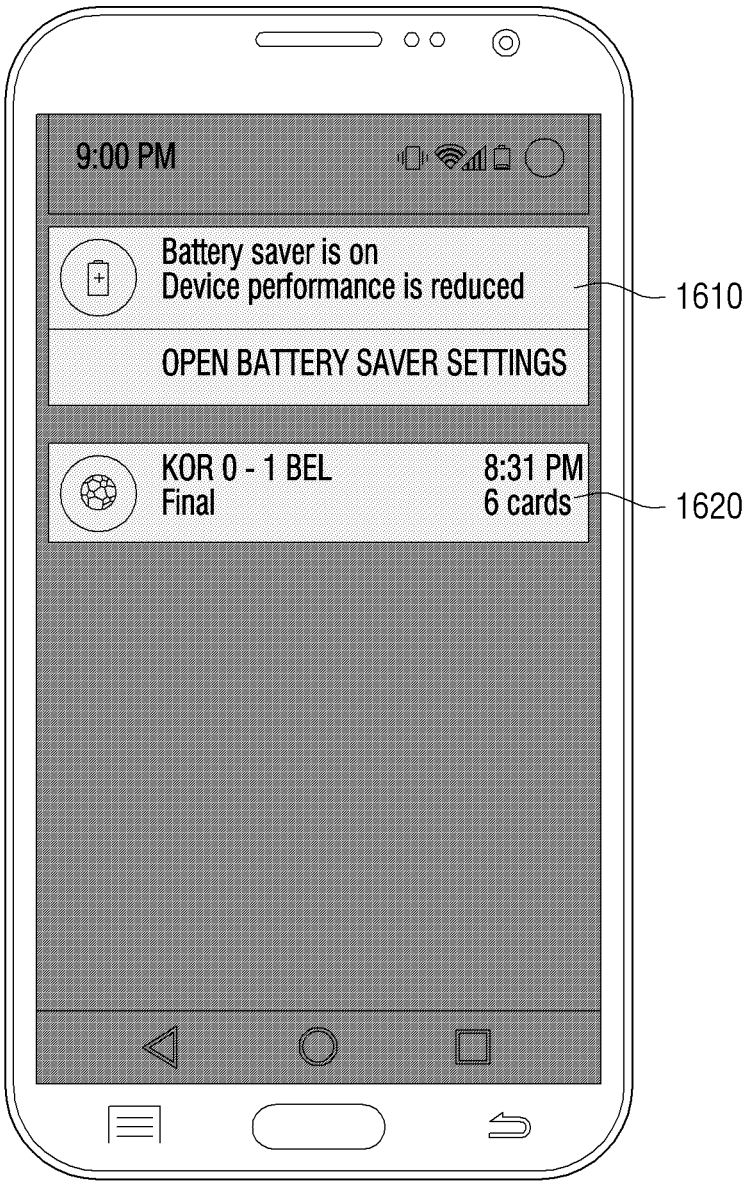
FIGS. 16A and 16B are views to illustrate a method for adjusting brightness according to a content attribute according to another exemplary embodiment.
Figure 16B:
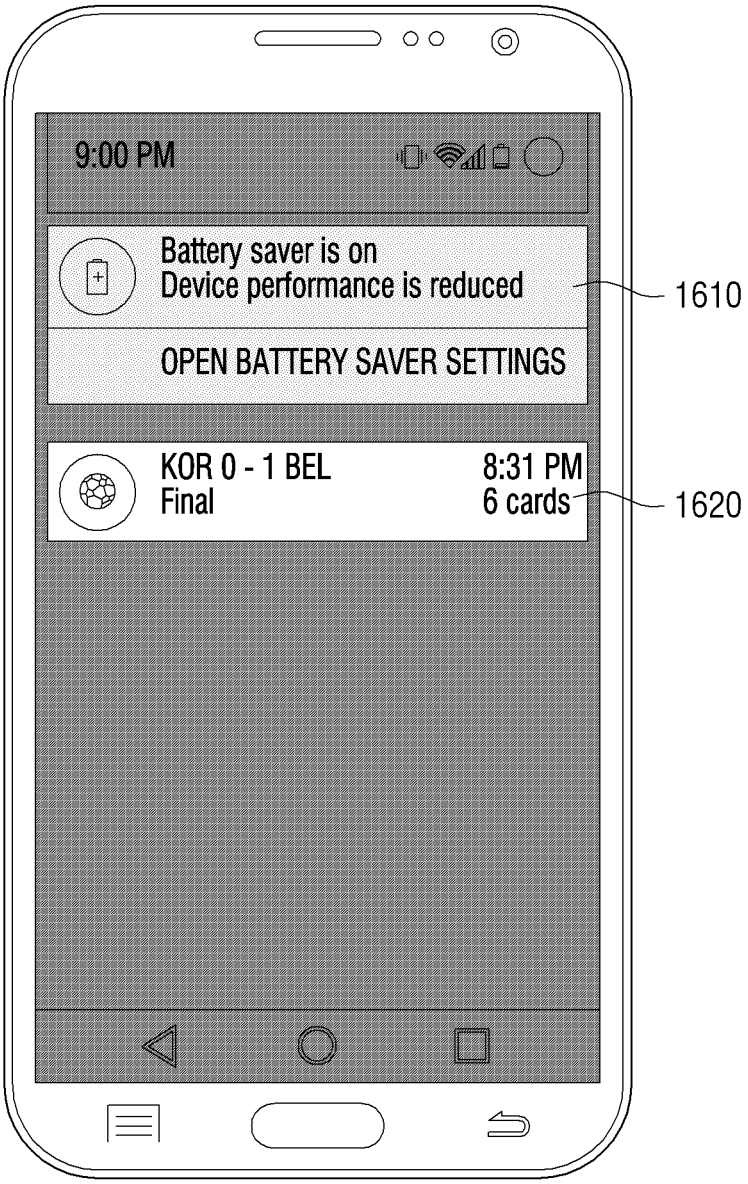

FIGS. 16A and 16B are views to illustrate a method for adjusting brightness according to a content attribute according to another exemplary embodiment.

According to another exemplary embodiment, based on the grayscale characteristic of an object area that satisfies a predetermined condition from among a plurality of object areas forming an image, the display brightness of the corresponding object area may be individually adjusted. Herein, the object area satisfying the predetermined condition may be a user's interest object area.

For example, when an image including a plurality of object areas 1610 and 1620 is provided as shown in FIG. 16A, the brightness of the interest object area 1620 may be adjusted differently from the brightness of the other interest object area 1610 as shown in FIG. 16B. Herein, the interest object area 1620 may be a recent message area, a notification message display area, etc. from among a plurality of message areas.

Figure 17:
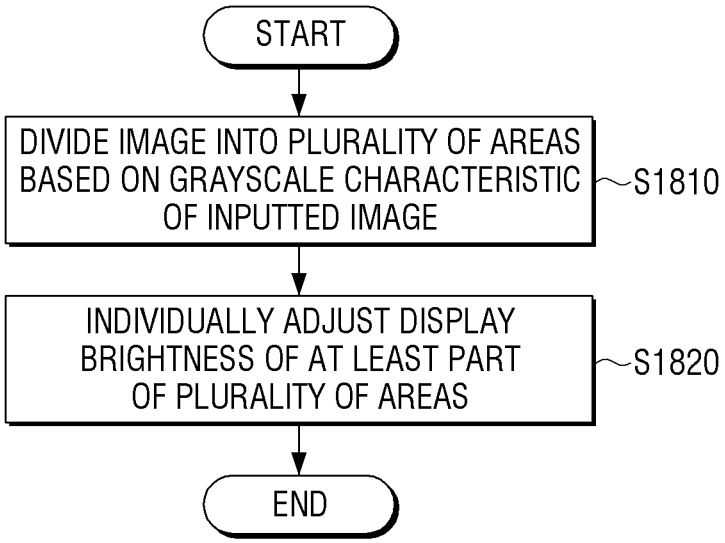
FIG. 17 is a flowchart to illustrate a control method of a display apparatus according to an exemplary embodiment.
Figure 18:
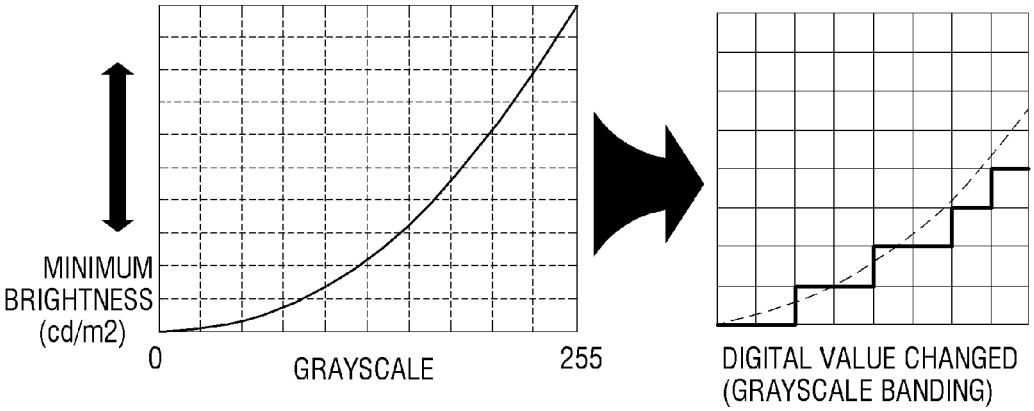
FIG. 18 is a view to illustrate a method for controlling brightness in a related-art LCD.

FIG. 17 is a flowchart to illustrate a control method of a display apparatus according to an exemplary embodiment. The display apparatus may include a display panel including a plurality of pixels, and may control the plurality of pixels on a pixel basis to emit light and thereby to display an image.

According to the flowchart shown in FIG. 17, the display apparatus may divide an image into a plurality of areas based on grayscale characteristics of the image (operation S1810). Herein, the plurality of pixels may be implemented by using a self-emitting element.

Next, the display panel may be driven to individually adjust brightness levels of at least one of the plurality of areas (operation S1820).

In operation S1820 of driving the display panel, a separate gamma table in which at least one of a minimum brightness level and a maxim brightness level is different may be applied to each of the plurality of areas, and the display panel may be driven to individually adjust display brightness of each area according to the applied gamma table.

Additionally, in operation S1820 of driving the display panel, the display panel may be driven by applying, to a first area having a relatively low grayscale from among the plurality of areas, a first gamma table having relatively low minimum and maximum brightness levels, and applying, to a second area having a relatively high grayscale, a second gamma table having relatively high minimum and maximum brightness levels.

In addition, the driving method may further include dividing at least one area from among the plurality of areas into a plurality of subareas based on a grayscale distribution of pixels forming the corresponding area. In this case, in operation S1820 of driving the display panel, the display panel may be driven to individually adjust display brightness of at least one of the plurality of subareas.

In addition, operation S1810 of dividing the image into the plurality of areas may including analyzing a grayscale histogram of the inputted image, dividing an entire grayscale section of the inputted image into a plurality of grayscale sections based on a grayscale distribution of pixels forming the inputted image, and dividing areas corresponding to the plurality of grayscale sections into the plurality of areas.

In operation S1820 of driving the display panel, the display panel may be driven to individually adjust display brightness of a corresponding area by applying a separate gamma table to at least one area corresponding to at least one of the plurality of grayscale sections.

In addition, operation S1810 of dividing the image into the plurality of areas may divide the inputted image into a plurality of areas according to a predetermined criterion, and, in operation S1820 of driving the display panel, the display panel may be driven to individually adjust display brightness of at least one of the plurality of areas based on a grayscale distribution of pixels forming the plurality of divided areas.

In addition, in operation S1820 of driving the display panel, the display panel may be driven to individually adjust display brightness of a corresponding object area based on a grayscale characteristic of the object area satisfying a predetermined condition from among a plurality of object areas forming the inputted image.

In addition, in operation S1820 of driving the display panel, when the display apparatus is operated in a low power mode, an inter-grayscale brightness mapping gap may be adjusted by rescaling at least one grayscale section of the image based on a maximum brightness level pre-set in the low power mode.

According to the various exemplary embodiments described above, power consumption of the self-emission display may be reduced and image quality may be enhanced.

The driving method of the display apparatus according to the above-described various exemplary embodiments may be implemented as a program and provided to the display apparatus.

For example, a non-transitory computer readable medium which stores a program for performing the operations of: dividing an image into a plurality of areas based on the grayscale characteristic of the inputted image; and individually adjusting the display brightness of at least one of the plurality of areas may be provided.

The non-transitory computer readable medium refers to a medium that stores data semi-permanently rather than storing data for a very short time, such as a register, a cache, a memory or etc., and is readable by an apparatus. Specifically, the above-described various applications or programs may be stored in the non-transitory computer readable medium such as a compact disc (CD), a digital versatile disk (DVD), a hard disk, a Blu-ray disk, a universal serial bus (USB), a memory card, a ROM or etc., and may be provided The foregoing exemplary embodiments are merely exemplary and are not to be construed as limiting. The present teaching can be readily applied to other types of apparatuses. Also, the description of the exemplary embodiments is intended to be illustrative, and not to limit the scope of the claims, and many alternatives, modifications, and variations will be apparent to those skilled in the art.

What is claimed is:

1. A display apparatus comprising:

a display panel comprising a plurality of pixels; and a processor configured to:

identify a background area and a foreground area in an image;

identify one or more objects from the foreground area;

control the display panel to apply different gamma curves to the background area and the objects of the foreground to individually adjust brightness of the background area and the objects based on greyscale values of the background area and the objects; and control the display panel to apply a gamma curve corresponding to a mode of the display apparatus to at least one of the background area or the objects, wherein at least one grayscale section of the gamma curve is adjusted based on a maximum brightness level according to the mode of the display apparatus.

2. The display apparatus of claim 1, wherein the processor is further configured to divide the foreground into a plurality of subareas according to a predetermined criterion, and control to individually adjust brightness of the plurality of subareas based on a grayscale distribution of pixels in the plurality of subareas.

3. The display apparatus of claim 1, wherein the processor is further configured to control to individually adjust the brightness of the objects based on a grayscale characteristic of the objects satisfying a predetermined condition.

4. The display apparatus of claim 1, wherein the mode includes a low power mode, and wherein the processor is further configured to adjust an inter-grayscale brightness mapping gap by rescaling the at least one grayscale section of the image based on the maximum brightness level pre-set in the low power mode in response to the display apparatus being operated in the low power mode.

5. The display apparatus of claim 1, wherein the plurality of pixels correspond to self-emitting elements.

6. A display apparatus comprising:

a display panel comprising a plurality of pixels; and a processor configured to:

identify a plurality of objects included in an image;

apply different gamma tables to each of a plurality of areas in the image; and control to individually adjust brightness of each of the plurality of areas based on the applied different gamma tables, and wherein the different gamma tables indicate a plurality of different exponential growth rates of a brightness level according to a grayscale level increase, and comprise at least one of a minimum brightness level and a maximum brightness level different from each other.

7. The display apparatus of claim 6, wherein the different gamma tables comprise a first gamma table and a second gamma table that has a higher minimum brightness level and a higher maximum brightness level than the first gamma table, and the plurality of areas comprise a first area and a second area that has a higher greyscale than the first area, wherein the processor is further configured to apply the first gamma table to the first area and apply the second gamma table to the second area.

8. A driving method of a display apparatus which comprises a display panel including a plurality of pixels which are controlled on a pixel basis to display an image, the driving method comprising:

identifying a background area and a foreground area in the image;

identifying one or more objects from the foreground area; and driving the display panel to apply different gamma curves to the background area and the objects of the foreground to individually adjust brightness of the background area and the objects based on greyscale values of the background area and the objects, wherein the driving the display panel comprises, controlling the display panel to apply a gamma curve corresponding to a mode of the display apparatus to at least one of the background area or the objects, and wherein at least one grayscale section of the gamma curve is adjusted based on a maximum brightness level according to the mode of the display apparatus.

9. The driving method of claim 8, wherein the identifying the one or more objects comprises dividing the foreground into a plurality of subareas according to a predetermined criterion, and wherein the driving the display panel comprises driving the display panel to individually adjust brightness of the plurality of subareas based on a grayscale distribution of pixels in the plurality of subareas.

10. The driving method of claim 8, wherein the driving the display panel comprises driving the display panel to individually adjust the brightness of the objects based on a grayscale characteristic of the objects satisfying a predetermined condition.

11. The driving method of claim 8, wherein the mode includes a low power mode, and wherein the driving the display panel comprises, adjusting an inter-grayscale brightness mapping gap by rescaling the at least one grayscale section of the image based on the maximum brightness level pre-set in the low power mode in response to the display apparatus being operated in the low power mode.

12. The driving method of claim 8, wherein the plurality of pixels correspond to self-emitting elements.

13. A driving method of a display apparatus which comprises a display panel including a plurality of pixels which are controlled on a pixel basis to display an image, the driving method comprising:

identifying a plurality of objects included in the image; and driving the display panel to apply different gamma tables to each of a plurality of areas in the image and, and to individually adjust brightness of each of the plurality of area based on the applied different gamma tables, and wherein the different gamma tables indicate a plurality of different exponential growth rates of a brightness level according to a grayscale level increase and comprise at least one of a minimum brightness level and a maximum brightness level different from each other.

14. The driving method of claim 13, wherein the different gamma tables comprise a first gamma table and a second gamma table that has a higher minimum brightness level and a higher maximum brightness level than the first gamma table, and the plurality of areas comprise a first area and a second area that has a higher greyscale than the first area, wherein the driving the display panel comprises driving the display panel by applying the first gamma table to the first area applying the second gamma table to the second area.

15. A display apparatus comprising:

a display panel comprising a plurality of pixels;

a panel driver configured to drive the plurality of pixels on a pixel basis to display an image; and a processor configured to identify a grayscale characteristic of each of the plurality of pixels, identify a background area and a foreground area in the image, identify one or more objects from the foreground area, and apply different gamma curves to the background area and the objects of the foreground to individually adjust brightness of the background area and the objects based on the grayscale characteristic, wherein the different gamma curves correspond to a plurality of different exponential growth rates of a brightness level according to a grayscale value increase.

* * * * *